US005434761A

United States Patent [19]

Lesnick et al.

[11] Patent Number: 5,434,761

[45] Date of Patent: Jul. 18, 1995

[54] SQUEEZE FLASHLIGHT

[75] Inventors: Daniel Lesnick, Newtown, Pa.; Wang T. Wong, New Territory, Hong Kong

[73] Assignee: With Design in Mind, Chatsworth, Calif.

[21] Appl. No.: 249,299

[22] Filed: May 25, 1994

[51] Int. Cl.[6] ..... F21L 1/00

[52] U.S. Cl. ..... 362/189; 362/190; 362/808; 446/485

[58] Field of Search ..... 362/109, 202, 205, 253, 362/189, 808, 157, 203, 190; 446/72, 485

[56] References Cited

U.S. PATENT DOCUMENTS

| | | | |
|---|---|---|---|
| 1,166,410 | 12/1915 | Glass | 446/485 |
| 2,483,820 | 10/1949 | Falge . | |
| 2,545,851 | 3/1951 | Kardos . | |
| 2,553,307 | 5/1951 | Falge . | |
| 2,694,772 | 11/1954 | Gelardin . | |
| 2,696,382 | 12/1954 | Gelardin . | |
| 2,932,917 | 4/1960 | Patane . | |
| 3,359,411 | 12/1967 | Schwartz . | |
| 4,464,861 | 8/1984 | Fogarty et al. . | |
| 4,734,074 | 3/1988 | Kinberg et al. | 446/485 |
| 4,752,273 | 6/1988 | Woods | 446/485 |
| 5,066,012 | 11/1991 | Stark | 446/485 |
| 5,114,376 | 5/1992 | Copley et al. | 446/485 |

*Primary Examiner*—Ira S. Lazarus
*Assistant Examiner*—Y. Quach
*Attorney, Agent, or Firm*—Kelly Bauersfeld & Lowry

[57] ABSTRACT

A novelty flashlight is provided with a deformable body in the shape of a novelty character, wherein manual squeezing of the deformable body is effective to close an electrical circuit to energize a lamp. The flashlight includes a flashlight unit adapted to fit within the deformable body and to support one or more button cell batteries. A switch member is movably mounted on the flashlight unit and functions, upon manual squeezing of a selected region of the deformable body, to close an electrical circuit including the batteries and a lamp. The lamp is mounted on a base member to provide beam of light emanating from the bottom of the novelty character.

7 Claims, 2 Drawing Sheets

SQUEEZE FLASHLIGHT

BACKGROUND OF THE INVENTION

This invention relates generally to a novelty squeeze flashlight having a deformable body in the shape of a novelty character. More specifically, this invention relates to a relatively simple and easily operated squeeze flashlight having a compact battery case supporting one or more button cell batteries.

Squeeze flashlights of the type having a manually deformable outer housing are generally known in the art, wherein squeeze deformation of a selected portion of the housing is effective to manipulate circuit components in order to energize a battery powered lamp. Such flashlights have been designed in various sizes and shapes for use with standard flashlight batteries and lamp components. In some cases, the deformable body has been provided with a novelty character shape as disclosed, for example, in U.S. Pat. No. 2,694,772. In this regard, prior squeeze flashlights have commonly used elongated batteries such as "AA" or "AAA" size batteries, wherein the specific battery used has a major influence on the overall size and shape of the deformable flashlight body. Moreover, common batteries of this general type have a relatively limited service life, wherein the deformable body is normally designed for occasional opening to permit battery removal and replacement.

In recent years, advancements in battery technology have led to the development of relatively small, so-called button cell batteries which have a relatively long service life and are commonly used in watches, calculators, and other compact electronic devices.

The present invention is directed to an improved squeeze flashlight of the type having a deformable outer body in the shape of a novelty character, in combination with an internal flashlight unit adapted for receiving and supporting one or more button cell batteries.

SUMMARY OF THE INVENTION

In accordance with the invention, a squeeze flashlight includes a deformable outer body in the shape of a selected novelty character, and having a flashlight unit mounted therein. The flashlight unit includes one or more button cell batteries together with a movable switch member adapted to close an electrical circuit when a selected portion of the deformable body is squeezed or compressed, resulting in energization of a lamp. The lamp is positioned to provide a beam of light emanating downwardly from the bottom of the novelty character.

More specifically, in accordance with the preferred form of the invention, the flashlight unit comprises a compact base member adapted for seated mounting within a central opening formed at the bottom of a hollow deformable body defining the novelty character. A lamp post extends upwardly within the deformable body and cooperates with the base member to support and retain a miniature lamp in a position to provide a beam of light downwardly through a central port formed in the base member. The upper end of the lamp post is joined to a circular support ring for receiving and supporting a battery case having one or more button cell batteries therein.

A switch member is movably carried on the battery case and includes a conductive terminal which is spring-loaded toward a normal position spaced from the batteries. The switch member is manually movable by squeezing or compressing the deformable body at a selected region thereof to move the conductive terminal into contact with the batteries. When such contact occurs, an electrical circuit including the batteries and the lamp is closed, resulting in energization of the lamp. Release of the switch member permits spring-loaded return of the conductive terminal to its normal position spaced from the batteries, such that the lamp is deenergized.

Thus, the squeeze flashlight of the present invention constitutes a novelty character in the form of a decorative item. When use of the product as a flashlight is desired, the product is picked up and a portion of the deformable body is squeezed to close the circuit, providing a beam of light emanating from the base member.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
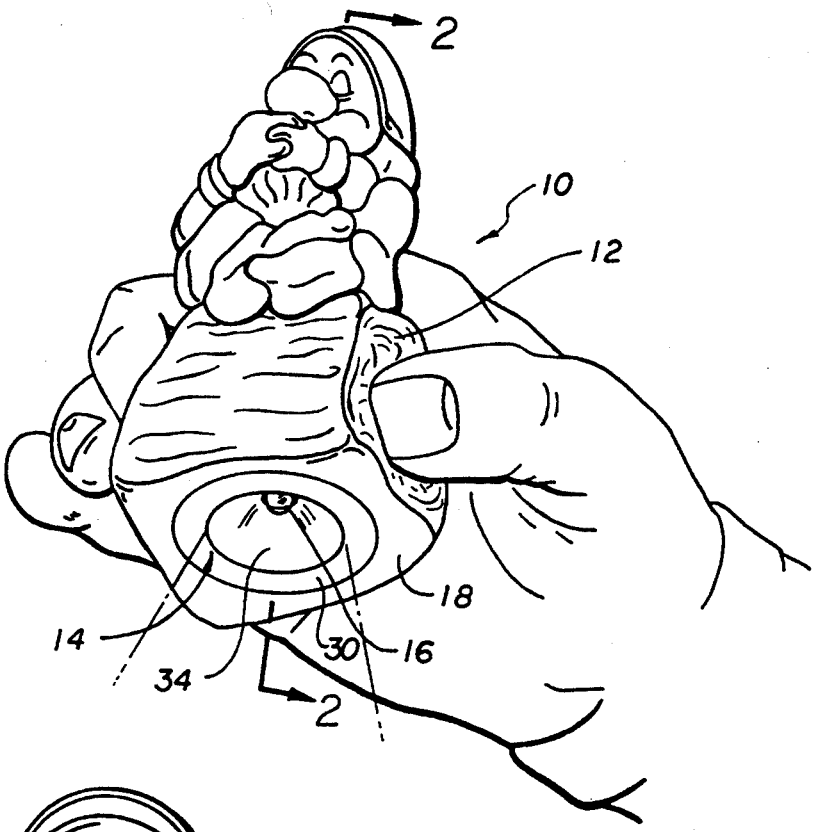
FIG. 1 is a perspective view illustrating a novelty squeeze flashlight constructed in accordance with the present invention.
Figure 2:
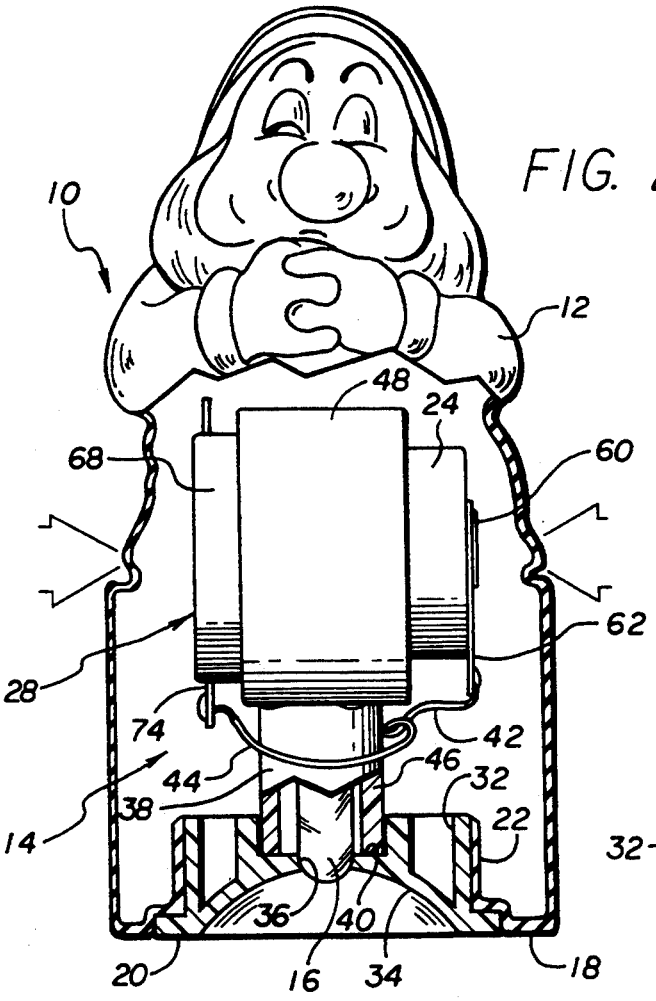
FIG. 2 is an enlarged front elevational view, shown partially in vertical section, and depicting a flashlight unit mounted within a deformable outer body in the shape of a novelty character.
Figure 3:
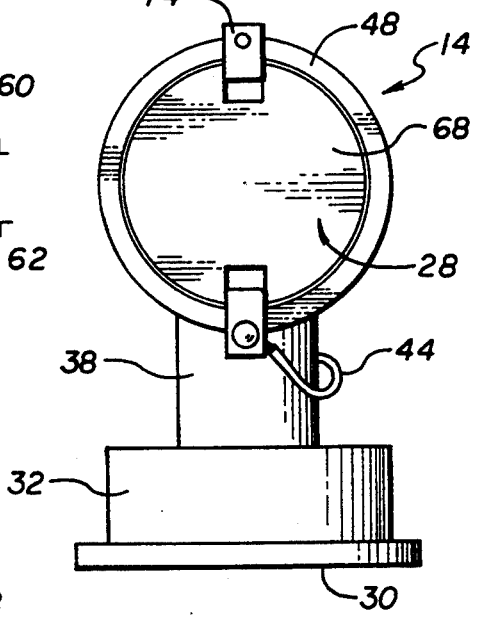
FIG. 3 is a left side elevational view of the flashlight unit shown in FIG. 2.
Figure 4:
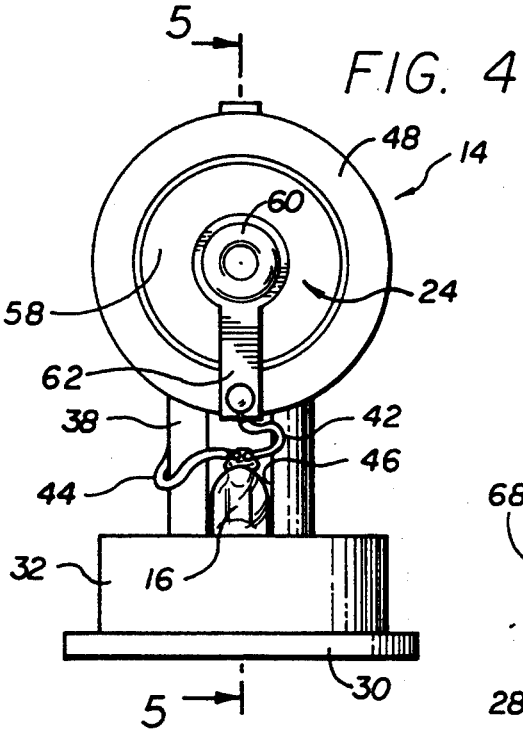
FIG. 4 is a right side elevational view of the flashlight unit shown in FIG. 2.
Figure 6:
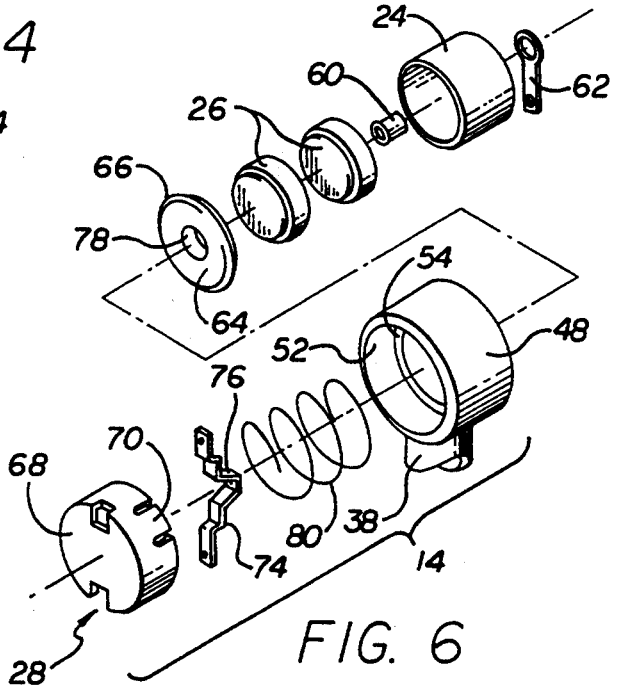
FIG. 6 is a fragmented exploded perspective view illustrating assembly of portions of the flashlight unit depicted in FIGS. 2–5.
Figure 5:
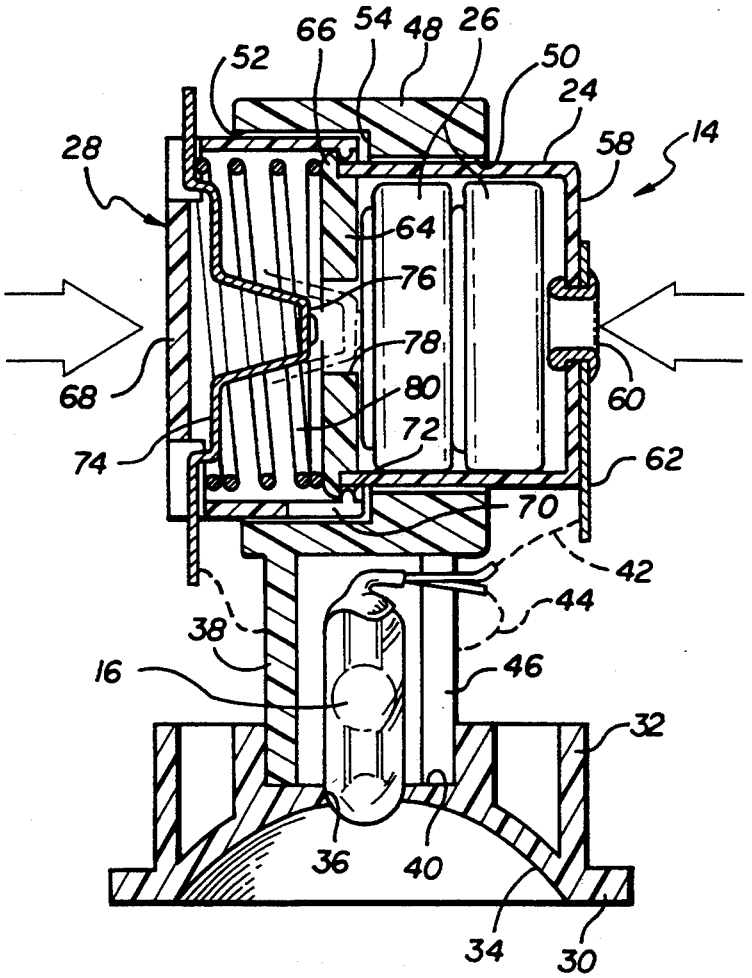
FIG. 5 is an enlarged vertical sectional view taken generally on the line 5—5 of FIG. 4, and illustrating operation of the flashlight.

As shown in the exemplary drawings, a squeeze flashlight referred to generally by the reference numeral 10 includes an outer deformable body 12 in the shape of a novelty character. A flashlight unit 14 is contained within the deformable body 12 and includes a lamp 16 which is energizable to provide a beam of light when a selected portion of the deformable body 12 is manually squeezed or compressed. As shown in FIGS. 1 and 2, the lamp 16 is positioned to provide the light beam emanating or projecting downwardly from the bottom of the novelty character.

The squeeze flashlight 10 of the present invention is designed as a novelty product intended particularly for children and young adults as a souvenir or collectable item. The deformable body 12 is formed from a cast vinyl rubber or other suitable elastomer to provide a hollow structure in the shape of a selected novelty character. The deformable body is shaped to define a relatively flat bottom wall 18 having a circular central opening 20 (FIG. 2) formed therein. This central opening 20 is conveniently lined by a cylindrical support wall 22 which projects a short distance into the interior of the deformable body 12, and facilitates secure mounting of the flashlight unit 14, as will be described.

As shown in FIGS. 2–6, the flashlight unit 14 is adapted for mounting within the hollow interior of the deformable character body 12. The flashlight unit 14 has a relatively simple and highly compact construction to include a battery case 24 for receiving and supporting one or more small button cell batteries 26. The batteries are movably mounted with respect to a switch member 28, such that an electrical circuit including the batteries 26 and the lamp 16 is closed or completed in response to laterally inward fingertip compression applied to the laterally opposed sides of the deformable body 12 in the vicinity of the battery case 24 (FIGS. 1 and 2).

More specifically, the flashlight unit 14 includes a base member 30 having a generally cylindrical shape for seated press-fit installation into the central opening 20 at the bottom of the deformable body 12. The base member 30 includes a cylindrical outer wall 32 which engages the cylindrical support wall 22 of the deformable body 12, and these cylindrical walls 22, 32 may be fixed to each other by means of a suitable adhesive. The underside of the base member 30 is shaped to define a concave domed cavity 34, with a central lamp port 36 formed therein.

A generally cylindrical lamp post 38 extends upwardly from the base member 30, within the deformable body 12. This lamp post has a lower end seated within a shallow counterbore 40 formed in the base member 30, and these components may be securely attached to one another by means of a suitable adhesive. The lamp 16 is positioned within the hollow interior of the lamp post 38, with a tip or nose end of the lamp 16 disposed within the lamp port 36 of the base member 30. A pair of conductive wires 42 and 44 are appropriately attached to the lamp 16 and extend therefrom through a longitudinal slot 46 formed in the lamp post 38.

The upper end of the lamp post 38 is joined to a generally cylindrical support ring 48 which defines a stepped bore to include first and second bore segments 50 and 52. As shown best in FIG. 5, the diametric size of the bore segment 50 is somewhat smaller than the diametric size of the bore segment 52, thus defining a radially oriented annular step or shoulder 54 at the juncture of the bore segments 50, 52. In the preferred form, the support ring 48 is constructed as a plastic molding integral with the lamp post 38.

The battery case 24 comprises a generally cup-shaped housing having an internal diametric size for slide-fit reception of the button cell batteries 26. The external diametric size of the battery case accommodates slide-fit reception within the smaller bore segment 50 of the support ring 48. A base wall 58 is formed at one end of the battery case and supports a conductive terminal such as a rivet 60 fastened centrally through the base wall 58. As shown, the conductive rivet 60 is also fastened to a conductive metal strip 62 which protrudes radially beyond the periphery of the battery case 24 and has its distal end appropriately secured as by soldering to the conductive wire 42. The opposite end of the battery case 24 is closed by a disk-shaped cap 64 which defines a radially outwardly projecting peripheral lip 66 having a diametric size slightly greater than the size of the smaller bore segment 50. Accordingly, the battery case 24 is slidably movable back-and-forth along the axis of the smaller bore segment 50, with the cap lip 66 and the conductive metal strip 62 cooperating to prevent axial removal of the battery case from the support ring 48.

The switch member 28 comprises a second cup-shaped housing 68 having a size and shape for slide-fit reception into the larger bore segment 52 of the support ring 48. As shown, the open end of this housing 68 includes slotted teeth 70 with inwardly radiating ribs 72 for snap-fit reception over the peripheral lip 66 on the battery case 24. A second conductive metal strip 74 is mounted within the housing 68 of the switch member 28 and is shaped to define an axially protruding switch contact 76 having a size to fit through a switch port 78 formed centrally in the cap 64 of the battery case 24. A compression spring 80 reacts between the cap 64 and a base wall of the switch member housing 68 for normally positioning the switch contact 76 in spaced relation to the batteries 26. At least one end of the conductive strip 74 projects radially outwardly from the switch member housing 68, beyond the diametric size of the larger bore segment 52, and is appropriately connected as by soldering to the other conductive wire 44.

In operation, laterally inward manual fingertip pressure apply generally along a central axis of the support ring 48 is effective to press the switch contact 76 through the switch port 78 into direct engagement with the face of the adjacent battery 26. When this contact occurs, an electrical circuit including the batteries 26 and the lamp 16 is completed, such that the batteries 26 engergize the lamp 16. The lamp 16 remains energized, to shine a light from the bottom of the deformable body (FIG. 1), as long as the manual pressure is maintained to close the electrical circuit. Release of this manual pressure enables the spring 80 to displace the switch contact 76 into spaced relation from the adjacent battery 26, thereby opening the circuit and deenergizing the lamp 16.

The squeeze flashlight 10 of the present invention thus provides a novelty product which may also function as a small flashlight or penlight. The button cell batteries 26 provide relatively long service life, yet enable the flashlight unit to be sufficiently economical in construction such that the entire product can be discarded, if desired, when the batteries are exhausted.

A variety of modifications and improvements to the squeeze flashlight 10 of the present invention will be apparent to those skilled in the art. Accordingly, no limitation on the invention is intended by way of the foregoing description and accompanying drawings, except as set forth in the appended claims.

What is claimed is:

1. A squeeze flashlight, comprising:

a deformable body formed in a novelty shape with a generally hollow interior and defining a bottom with an opening formed therein; and a flashlight unit mounted within said deformable body, said flashlight unit including a base member seated generally within said opening, a lamp, means for mounting said lamp generally within the interior of said body in a position with said lamp being visible via a lamp port formed in said base member, a battery case for receiving and supporting at least one button cell battery, and circuit means for electrically connecting said lamp and battery in a closed circuit to energize said lamp, said circuit means including a switch member movably carried on said battery case for closing the circuit in response to manual pressure applied to a selected portion of said deformable body;

said flashlight unit further including an annular support ring having said battery case movably carried therein, said switch chamber being movably carried on said support ring and including a conductive terminal movable in response to manual pressure applied to the selected portion of the deformable body to close the circuit, and spring means for normally retaining said conductive terminal in a position with the circuit open.

2. A squeeze flashlight comprising:

a deformable body formed in a novelty shape with a generally hollow interior and defining a bottom with an opening formed therein; and a flashlight unit mounted within said deformable body;

said flashlight unit including a base member seated generally within said opening and defining a lamp port, a generally hollow lamp post projecting from said base member into the interior of said deformable body, a generally annular support ring carried by said lamp post within said deformable body, and a lamp mounted generally within said lamp post in a position with said lamp being visible via said lamp port;

said flashlight unit further including a battery case having at least one button cell battery therein and first terminal means for electrically connecting one side of said battery to said lamp, said battery case being movably carried within said support ring;

said flashlight unit further including a switch member movably carried by said support ring, said switch member having second terminal means movable toward said battery upon manual squeezing of a selected portion of the deformable body to electrically connect an opposite side of said battery to said lamp to close an electrical circuit including said battery and lamp thereby energizing said lamp, and spring means for normally maintaining said second terminal means in spaced relation with said battery.

3. The squeeze flashlight of claim 2 wherein said support ring defines a stepped internal bore having first and second bore segments of different diametric size, said battery case being slidably carried within one of said bore segments, said switch member including a generally cup-shaped housing slidably carried within the other of said bore segments for movement of said switch member and said battery case axially toward one another in response to manual squeezing of the selected portion of the deformable body.

4. The squeeze flashlight of claim 3 wherein said battery case comprises an open-ended cup-shaped housing having said at least one button cell battery therein, and a cap mounted over the open end of said housing, said cap having a central terminal port therein and defining a peripheral lip having a diametric size greater than the diametric size of said open-ended cup-shaped housing, said switch member including means for snap-fit mounting over said lip for movably retaining said open-ended cup-shaped switch member on said battery case, said second terminal means being carried by said switch member to extend through said cap terminal port and contact the battery within said battery case when the selected portion of the deformable body is squeezed.

5. A squeeze flashlight, comprising:

a deformable body formed in a novelty shape with a generally hollow interior and defining a central opening in a bottom wall thereof;

a base member seated generally within said central opening, and defining a lamp port;

a hollow lamp post extending from said base member into the interior of said deformable body;

a generally annular support ring carried by said lamp post within the deformable body, said support ring defining a stepped bore with a first bore segment and a comparatively larger second bore segment;

a lamp carried within the lamp post in a position with said lamp being visible via said lamp port;

a battery case including at least one button cell battery an open-ended and generally cup-shaped housing having a diametric size for slidable reception within said first bore segment of said support ring;

a switch member including a conductive terminal slidably mounted within said second bore segment of said support ring, said switch member and said battery case being movable within said support ring toward each other in response to manual pressure applied to opposite sides of the deformable body, to displace said conductive terminal into contact with said battery;

circuit means for connecting said battery and lamp in a closed circuit to energize the lamp when said conductive terminal contacts the battery; and spring means for normally retaining said conductive terminal in spaced relation with the battery.

6. A squeeze flashlight, comprising:

a deformable body formed in a novelty shape with a generally hollow interior and defining a bottom with an opening formed therein; and a flashlight unit mounted within said deformable body, said flashlight unit including a base member seated generally within said opening, a lamp for providing a beam of light, a battery case for receiving and supporting at least one button cell battery, a hollow lamp post extending between said base member and said battery case, said lamp being mounted within said hollow lamp post and visible via a lamp port formed in said base member, and circuit means for electrically connecting said lamp and battery in a closed circuit to energize said lamp, said circuit means including a switch member movably carried on said battery case for closing the circuit in response to manual pressure applied to a selected portion of said deformable body.

7. A squeeze flashlight, comprising:

a deformable body formed in a novelty shape with a generally hollow interior and defining a bottom with an opening formed therein; and a flashlight unit mounted within said deformable body, said flashlight unit including a base member seated generally within said opening, a lamp, means for mounting said lamp generally within the interior of said body in a position with said lamp being visible via a lamp port formed in said base member, a battery case for receiving and supporting at least one button cell battery, circuit means for electrically connecting said lamp and battery in a closed circuit to energize said lamp, said circuit means including a switch member movably carried on said battery case for closing the circuit in response to manual pressure applied to a selected portion of said deformable body, said flashlight unit further including a support ring having said battery case and said switch member movably mounted thereon, and spring means for normally positioning said switch member in a position with the circuit open.

* * * * *